US008502776B2

(12) United States Patent
Kamentser et al.

(10) Patent No.: US 8,502,776 B2
(45) Date of Patent: Aug. 6, 2013

(54) JOYSTICK CONTROLLER

(75) Inventors: Boris Kamentser, Fountain Valley, CA (US); Eugenia Kamentser, Garden Grove, CA (US)

(73) Assignee: Bokam Engineering, Inc., Santa Ana, CA (US)

( * ) Notice: Subject to any disclaimer, the term of this patent is extended or adjusted under 35 U.S.C. 154(b) by 1175 days.

(21) Appl. No.: 11/803,442

(22) Filed: May 14, 2007

(65) Prior Publication Data

US 2008/0288093 A1 Nov. 20, 2008

(51) Int. Cl.
*G09G 5/08* (2006.01)

(52) U.S. Cl.
USPC ..... 345/161; 345/168

(58) Field of Classification Search
USPC ..... 463/36; 338/2, 47, 128; 700/85; 345/161; 434/262
See application file for complete search history.

(56) References Cited

U.S. PATENT DOCUMENTS 4,306,208 A * 12/1981 Coors ..... 336/30
4,459,440 A 7/1984 Wiczer
4,587,510 A 5/1986 Kim
4,590,454 A * 5/1986 Zettergren ..... 338/128
4,616,114 A * 10/1986 Strasser ..... 200/83 J
4,849,583 A 7/1989 Meyer
4,864,272 A * 9/1989 Cecchi et al. ..... 338/128
5,229,742 A 7/1993 Miyamoto et al.
5,325,081 A 6/1994 Roberts
5,929,846 A * 7/1999 Rosenberg et al. ..... 345/161
6,618,036 B1 9/2003 Tamaka
6,909,353 B2 * 6/2005 Romero Herrera et al. 338/32 H
2003/0137394 A1 * 7/2003 Romero Herrera et al. 338/32 H
2004/0164959 A1 * 8/2004 Rosenberg et al. ..... 345/161

* cited by examiner

*Primary Examiner* — Masud Ahmed
(74) *Attorney, Agent, or Firm* — Leonard Tachner

(57) ABSTRACT

A joystick controller in two-dimensional and one-dimensional versions. The 2-D version employs a unitary sensor surface structure having eight surface-mounted or deposited strain gauges configured as two full bridges or four surface-mounted or deposited strain gauges configured as two half bridges, one for the X direction and one for the Y direction. This unique strain gauge layout design permits a new level of mechanical simplicity not heretofore available in joystick controllers. There are essentially no moving parts to wear out. An elongated post or lever is, in the preferred embodiment, mechanically coupled to the sensor surface structure by a pair of co-axial robust coil springs to provide a psychologically appealing physical motion of the lever during activation of the joystick controller. In the 1-D version, a rotatable cam element is positioned between parallel elongated leaf springs. The cam element is positioned at one end of the springs. The other end of the springs is mechanically coupled to a strain gauge layout which comprises a full bridge or half bridge sensor.

2 Claims, 12 Drawing Sheets

JOYSTICK CONTROLLER

BACKGROUND OF THE INVENTION

1. Field of the Invention

The present invention relates to a joystick controller typically used for controlling heavy machinery, industrial equipment and the like. The invention relates more specifically to an improved joystick controller which employs strain gauges which are placed in tension and compression to indicate the position and direction of a moveable post.

2. Background Art

Joystick controllers or actuators provide an electrical signal responsive to the displacement of a rod or lever from a neutral position. Preferably, they permit accurate manifestations of lever movement in any direction (i.e., 360°) by generating signals along two orthogonal exes (i.e., x and y) based upon the respective displacement along each axis. Typically, they utilize variable resistors coupled to the lever through complex mechanical assemblies. Various examples of such assemblies are shown in prior art U.S. Pat. Nos. 4,306,208; 4,459,440; 4,587,510; 4,849,583; 5,229,742; and 6,618,036.

A variety of joysticks have been used to input commands to video game controllers or to control the motion of a cursor on a video screen. Examples include U.S. Pat. No. 4,488,017 to Lee and U.S. Pat. No. 4,501,939 to Hyltin et al. Devices of this type employ electrical contacts or switches which are actuated by motion of the joystick shaft. Most of these joysticks are able to sense the motion of the shaft in one of four or eight different radial directions but do not sense how far the shaft has moved in the chosen direction. The output signal is digital in the sense that each contact or switch actuated by the shaft motion is either open on closed. However, the digital resolution is exceedingly low (one binary bit of information for each of the eight detectable directions of shaft motion). Also, the electrical contacts in mechanically operated switches are subject to wear, corrosion, contamination, pitting and contact bounce. Joysticks of this type lack the resolution and reliability needed for control of powered wheelchairs, forklifts, machine tools, earth-moving machines, robotic devices, etc.

In an effort to achieve the very high resolution of joysticks employing resistive potentiometers while overcoming their well known reliability problems non-contact analog joysticks have been developed. Some use inductive techniques while others exploit optoelectronic devices. U.S. Pat. No. 4,658,678 to Frederiksen and U.S. Pat. No. 4,855,704 to Betz disclose joysticks in which motion of the shaft alters the inductance of a coil which is part of an oscillator circuit. Then, a property of the oscillator (frequency, amplitude or phase) is processed electronically to obtain an indication of shaft position. Variable transformer coupling between an excitation coil, moved by the joystick shaft, and fixed sensor coils is employed in U.S. Pat. No. 4,434,412 to obtain an analog signal indicative of shaft position. These approaches are more reliable than resistive potentiometers but are inherently non-linear (i.e., unlike resistive potentiometers which are normally fabricated to be very linear, the analog output signal from these inductive devices does not vary linearly with joystick shaft position). Electronic compensation of this inherent non-linearity is feasible but adds to cost and complexity. Furthermore, the analog signal must be processed through interface circuitry, typically including an analog-to-digital converter, before it can be used in a modern control system, almost all of which use digital microprocessors or microcomputers.

Thus, it can be seen that mechanical assemblies for analog joysticks tend to be mechanically complex and electrical assemblies for digital joysticks tend to be electronically complex. Both such complexities increase cost and reduce reliability. One solution to these disadvantages of the prior art is to employ joysticks using strain gauges.

In joystick assemblies, strain gauges are used to measure the force and the direction of the force applied to the joystick by the user. Such prior art joystick assemblies utilize a joystick support structure that is deflected or strained by the joystick. One example of a prior art joystick that employs strain gauges is disclosed in U.S. Pat. No. 5,325,081. However, this patent teaches an assembly wherein strain gauges are formed on spring-like planar surfaces that form a square tube around the joystick lever. This approach limits lever movement and generates material fatigue that can lead to reliability problems.

Another prior art joystick controller is disclosed herein in FIGS. 1-3. This controller solved many of the noted deficiencies of the patent art, but introduced end of travel anomalies that detracted from overall performance as will be described hereinafter.

Thus, there is still a need for a new type of joystick that overcomes the noted deficiencies of the prior art relating primarily to complexity, cost and reliability.

SUMMARY OF THE INVENTION

The present invention comprises joystick controller which addresses the aforementioned deficiencies of the prior art by employing a unitary sensor surface structure having surface-mounted strain gauges configured as full bridges, one for each direction of joy stick motion. This unique strain gauge layout design permits a new level of mechanical simplicity not heretofore available in joystick controllers. There are essentially no moving parts to wear out. An elongated post or lever is, in the preferred embodiment, mechanically coupled to the sensor surface structure by a robust spring to provide a psychologically appealing physical motion of the lever during activation of the joystick controller. However, the post could optionally be directly affixed to the sensor surface structure so that forces applied transversely to the post will be accurately sensed without any discernable movement.

The remaining elements of the controller merely provide a sealed housing for a printed circuit board for conditioning the output of the strain gauge bridges and to provide a suitable mechanical interface with a support structure for mounting the joystick controller. The joystick controller of the present invention is thus accurate, durable and reliable, simple in configuration and therefore of relatively low cost to manufacture and assemble. Its relatively simple mechanical configuration results in a commensurately small assembly that can be used as a replacement for most existing industrial joystick controllers without modification to existing support structure.

Two distinct embodiments are disclosed herein. In a first embodiment, a joystick post is configured for movement in two dimensions (X and Y) against the resistance provided by two co-axial coil springs. The post terminates at a sensor surface having eight strain gauges configured in two full bridges, one for X and one for Y. In a second embodiment, two one-dimensional joysticks are combined in one package. Each comprises a cam positioned between at least two elongated composite leaf springs which terminate in a sensor surface having a quad-layout of strain gauges configured as a full bridge indicating the extent of separation of the leaf springs caused by rotation of the cam.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
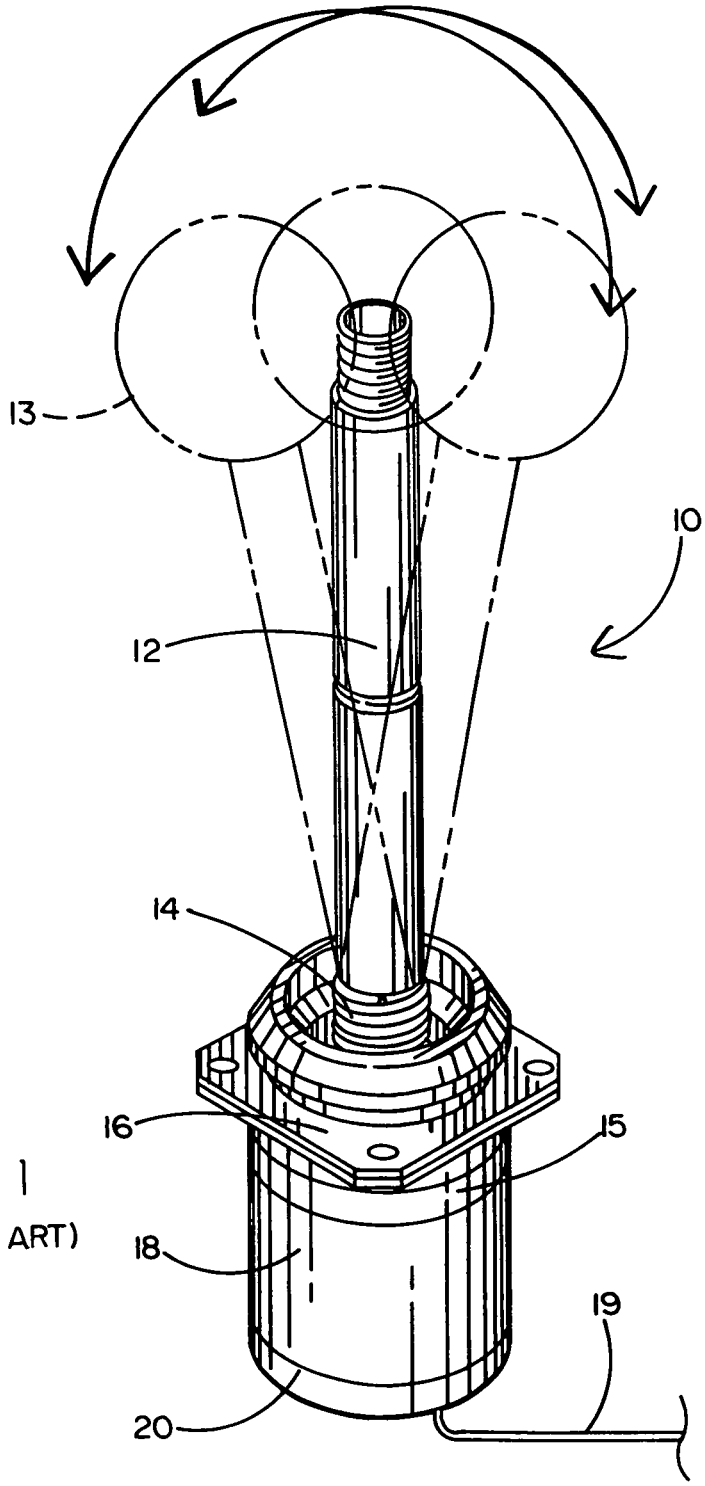
FIG. 1 (PRIOR ART)
FIG. 1 is a three-dimensional view of a prior art controller.
Figure 2:
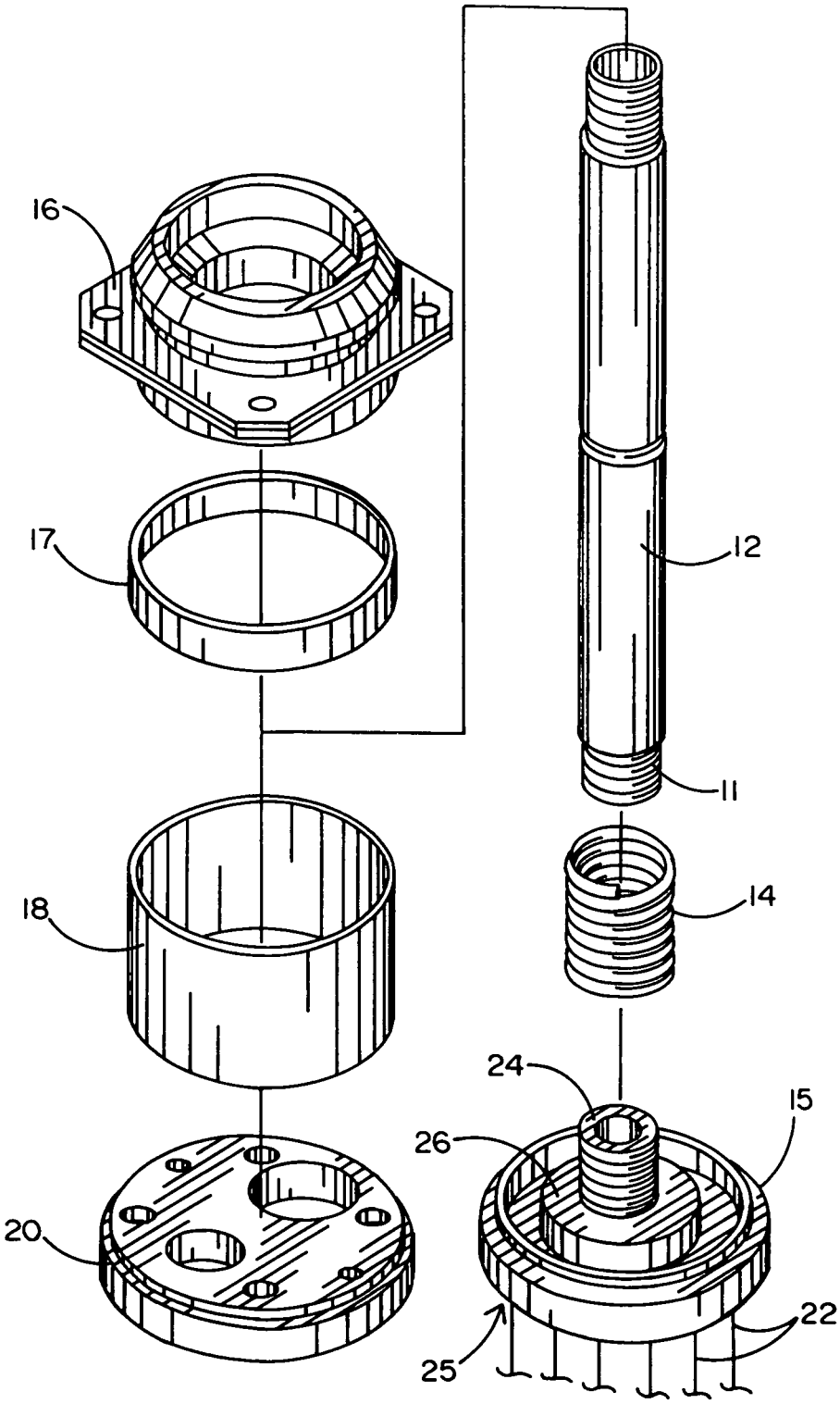
FIG. 2 (PRIOR ART)
FIG. 2 is an exploded view of the prior art joystick controller of FIG. 1.
Figure 3:
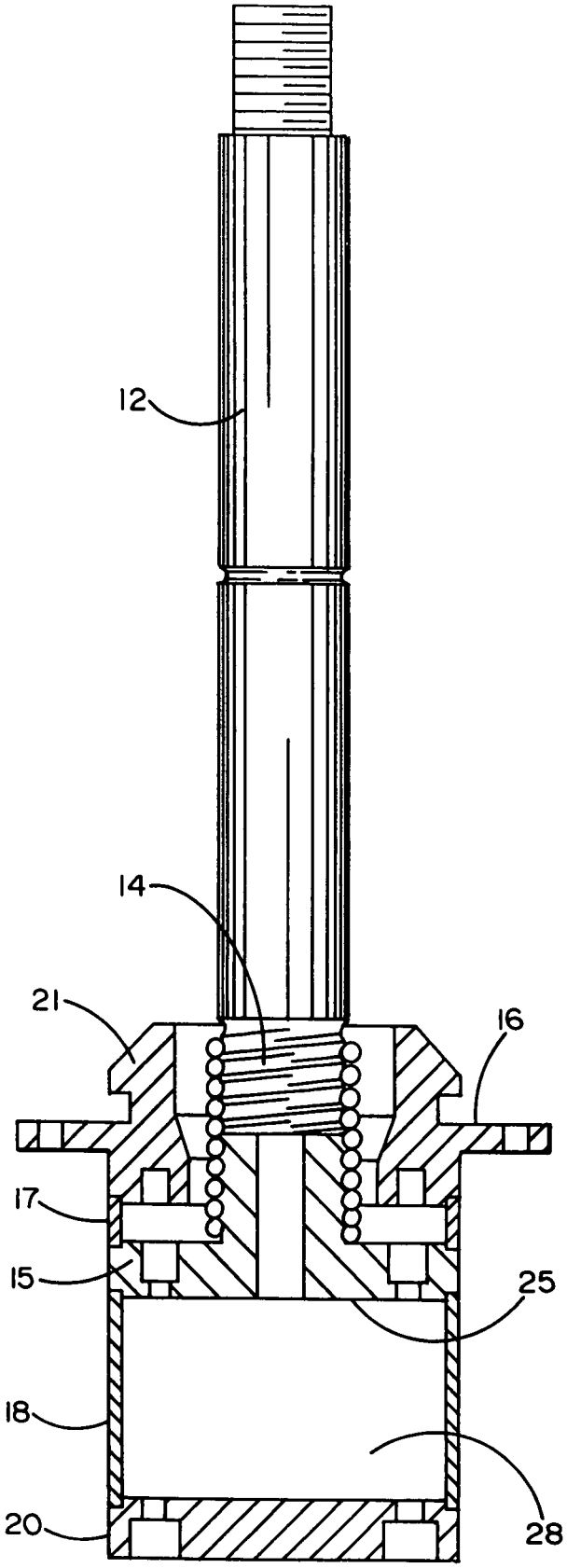
FIG. 3 (PRIOR ART)
FIG. 3 is a cross-sectional view of the prior art joystick controller of FIG. 1.
Figure 4:
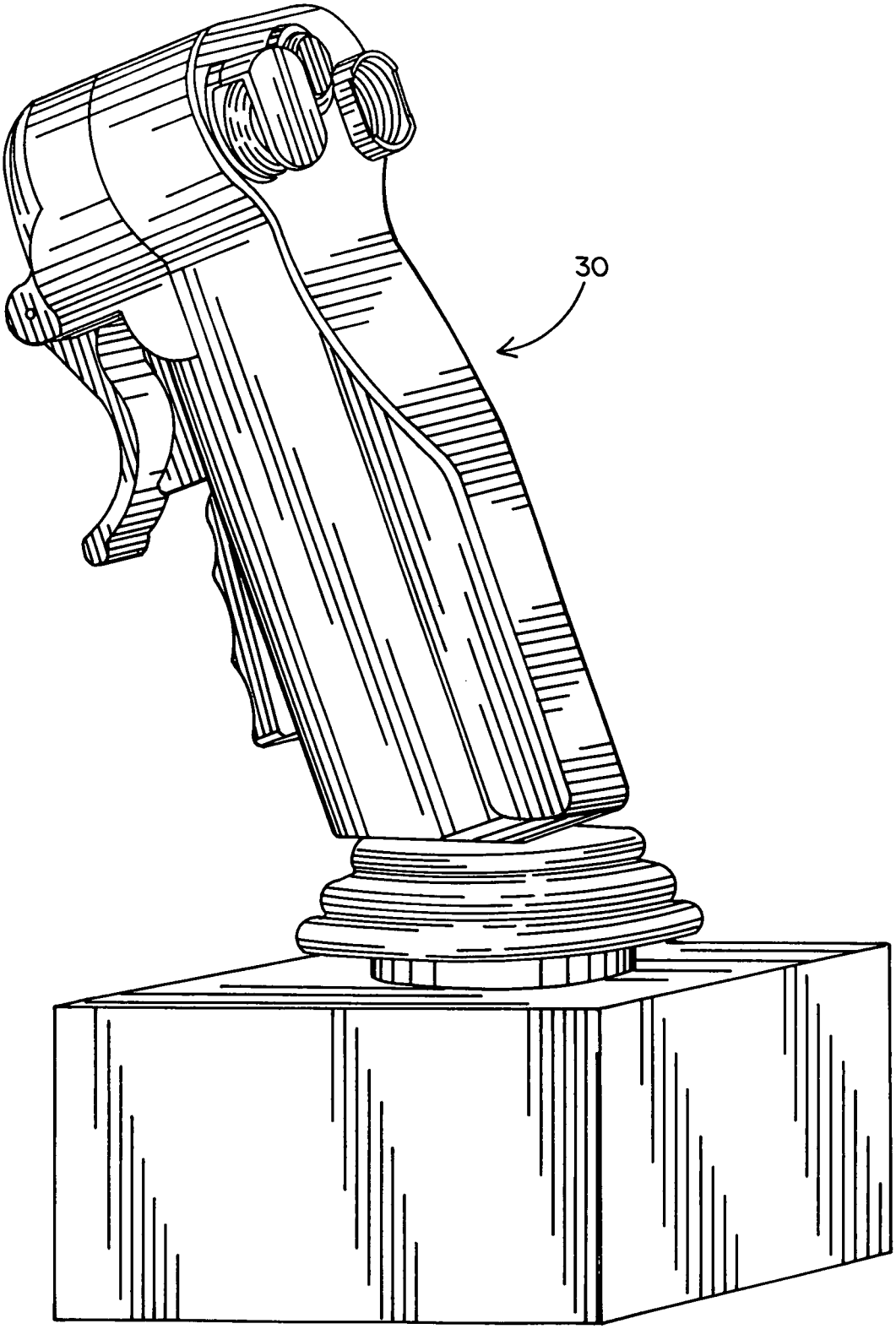
FIGS. 4 and 5 are back and front exterior views, respectively, of a first embodiment of the present invention.
Figure 5:
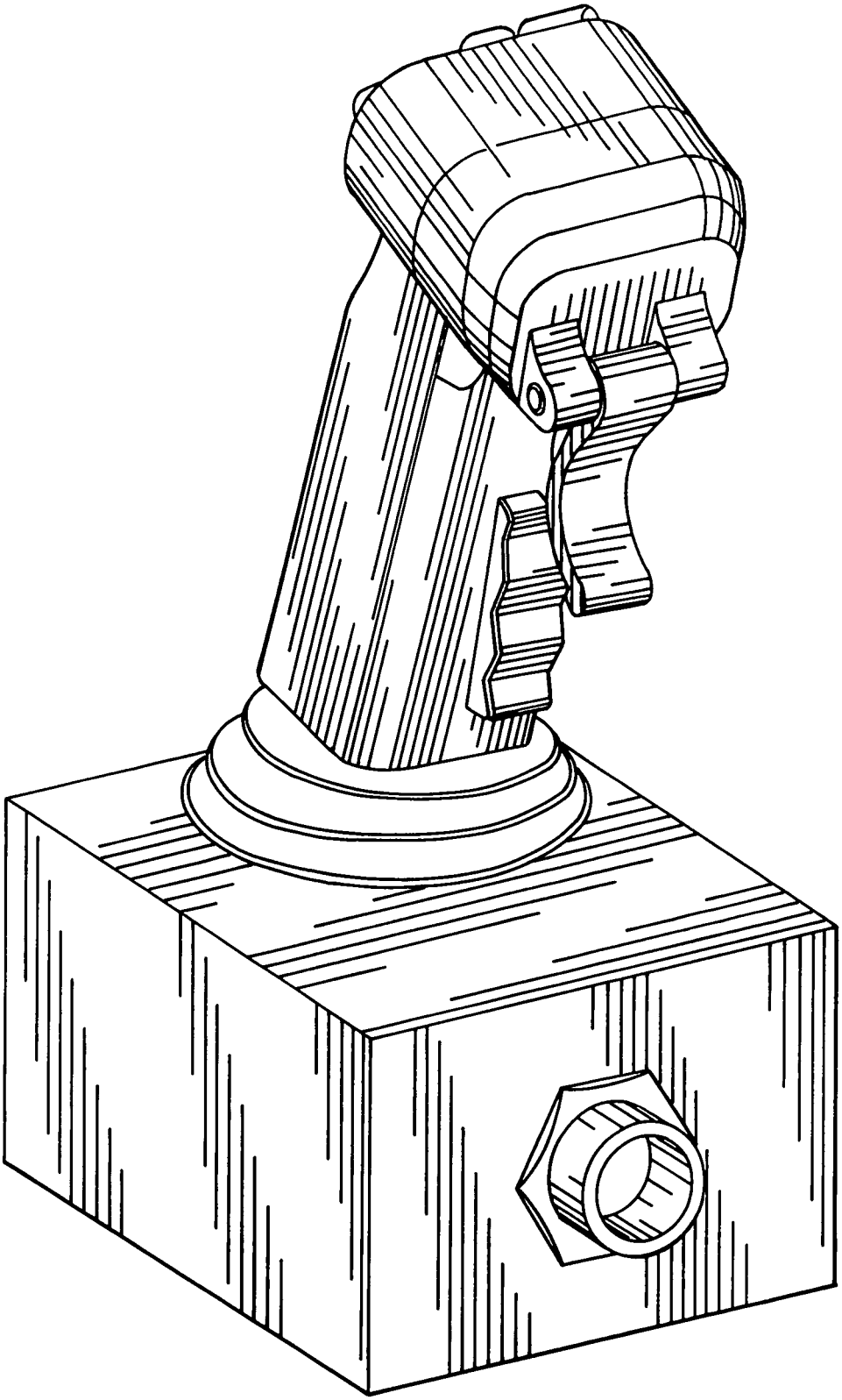
Figure 6:
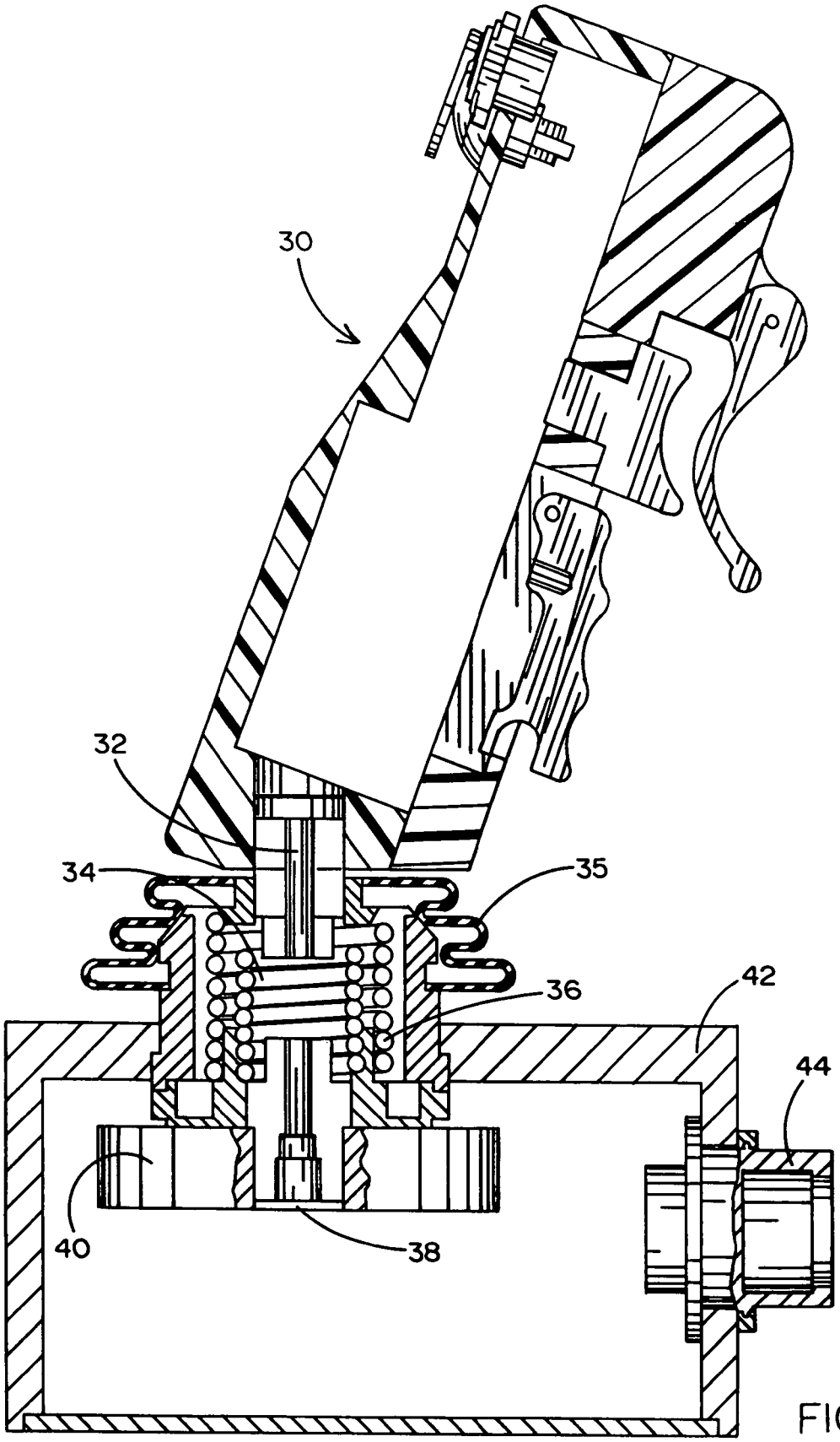
FIGS. 6 and 7 are cross-sectional views of the first embodiment of the invention showing a two-axis version which employs a pair of coaxial helical coil springs installed around an elongated post.
Figure 7:
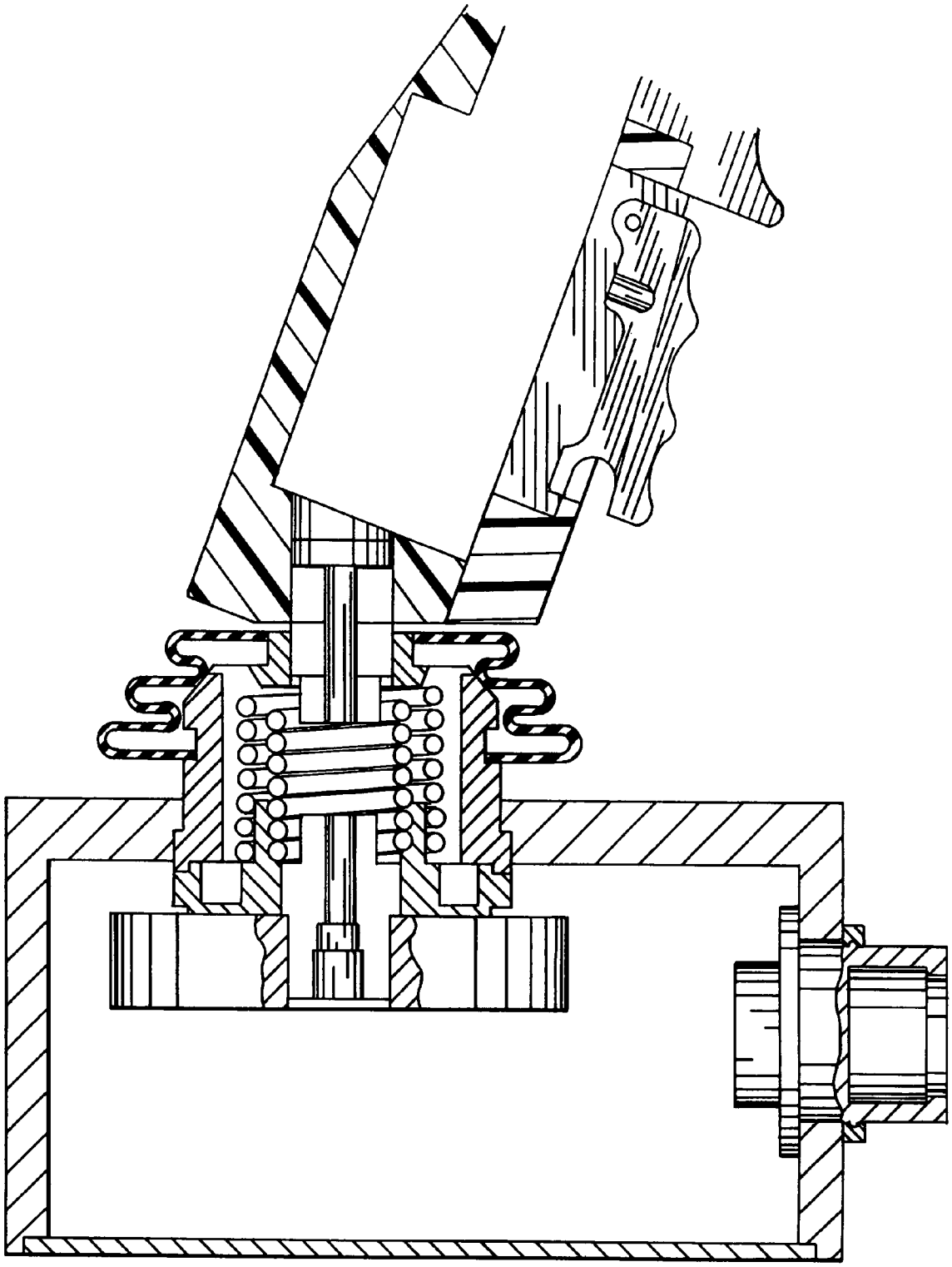

Referring to the accompanying drawings and FIGS. 1-3 in particular, it will be seen that a prior art joystick controller 10, comprises an elongated post 12, a helical coil spring 14, a sensor structure 15, a top member 16 and a tubular housing 18. Housing 18 is preferably closed off by a bottom member 20, the latter having one or more apertures to pass a cable 19. A collar 17 is preferably located between top member 16 and sensor structure 15. The post 12 may have a spherical knob 13 threaded onto the upper end to facilitate comfortable contact with the palm of a hand or the like. A flexible boot (not shown) may be used to enclose post 12 and spring 14 to prevent dust and dirt from contaminating those components. Post 12 has a lower threaded end 11 for threadably engaging spring 14.

Unfortunately, the prior art joystick controller of FIGS. 1-3 has a significant disadvantage relating to end of travel anomalies. Whenever the post 12 has been pushed to its mechanical limit (where it encounters the surrounding structure 21) the bottom end of the post begins to exert an oppositely-directed force against spring 14. This force creates strain gauge effects which produce an inaccurate manifestation of apparent continued motion of the post. Consequently, once the post reaches the structure 21 and force continues to be applied in that same direction, the signal produced by the strain gauge bridges becomes inaccurate and unreliable. Therefore, the prior art joystick controller of FIGS. 1-3 is not a satisfactory solution to the deficiencies of the earlier prior art.

Fortunately, the applicants hereof have found two post/spring embodiments which avoid such anomalies. A first such embodiment is shown in FIGS. 4-7. This embodiment is a two axis (X and Y) solution which specifically addresses the end of travel anomalies by employing a dual, co-axial helical spring configuration shown best in FIGS. 6 and 7. Joystick controller 30 comprises a post 32 mounted coaxially within an inner helical coil spring 34 and an outer helical coil spring 36. The bottom end of post 32 is mounted to a sensor surface 38 within sensor assembly 40. This assembly is mounted within housing 42 which provides a connector 44 for wiring interface (not shown). A flexible boot 35 protects the springs 34, 36 and encloses the housing 42.

Figure 8:
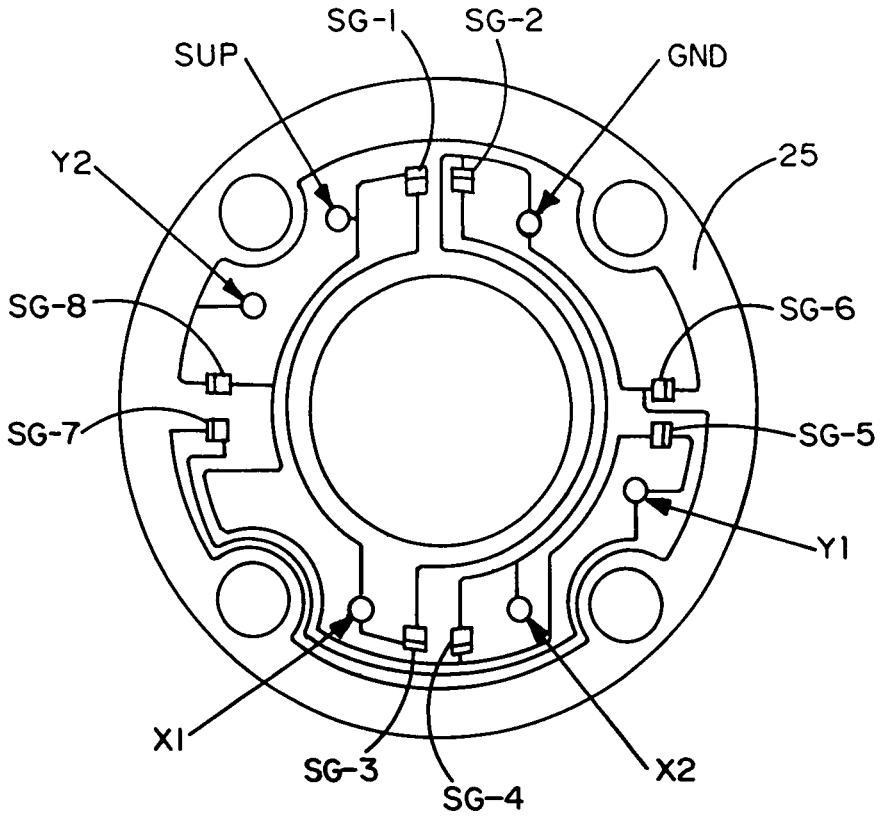
FIG. 8 is an elevational view of the strain gauge sensor surface of the preferred embodiment.

The end of travel anomalies of the prior art controller of FIGS. 1-3 are avoided in the embodiment of FIGS. 4-7 by keeping the post from reaching a mechanical limit and by employing the outer spring 36 to maintain a continuing direction of strain gauge influence even after the inner spring 34 has reached the end of its deformation limit. As a result, the signal output of the sensor assembly via the strain gauge bridges of FIGS. 8 and 9, remains relatively linear and accurate regardless of the force applied to the joystick.

Figure 9:
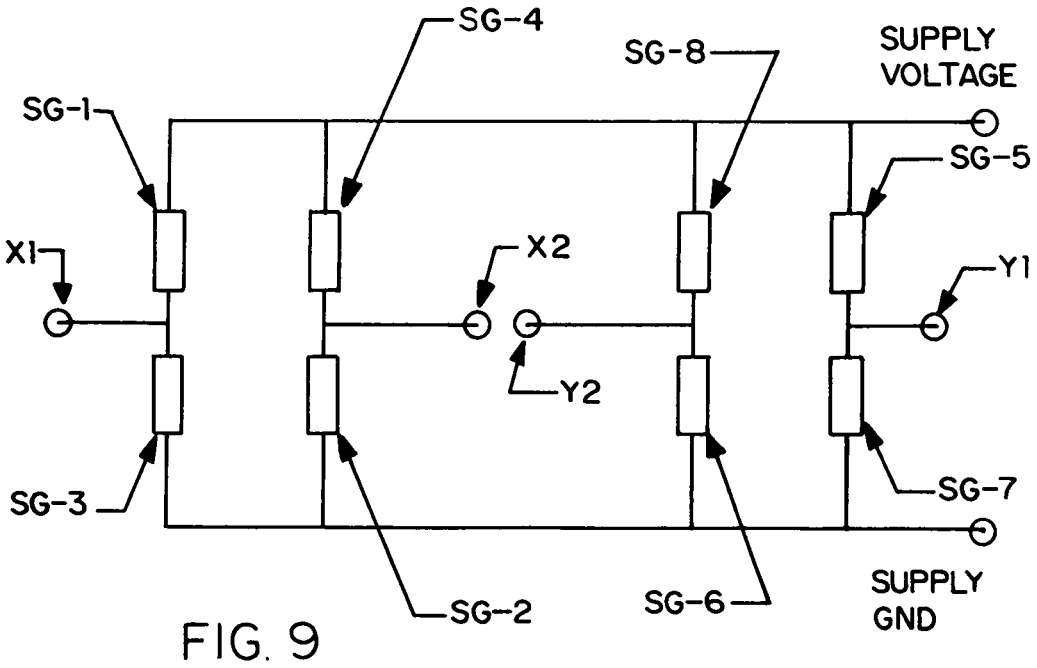
FIG. 9 is a schematic representation of the strain gauge layout of FIG. 8.
Figure 11:
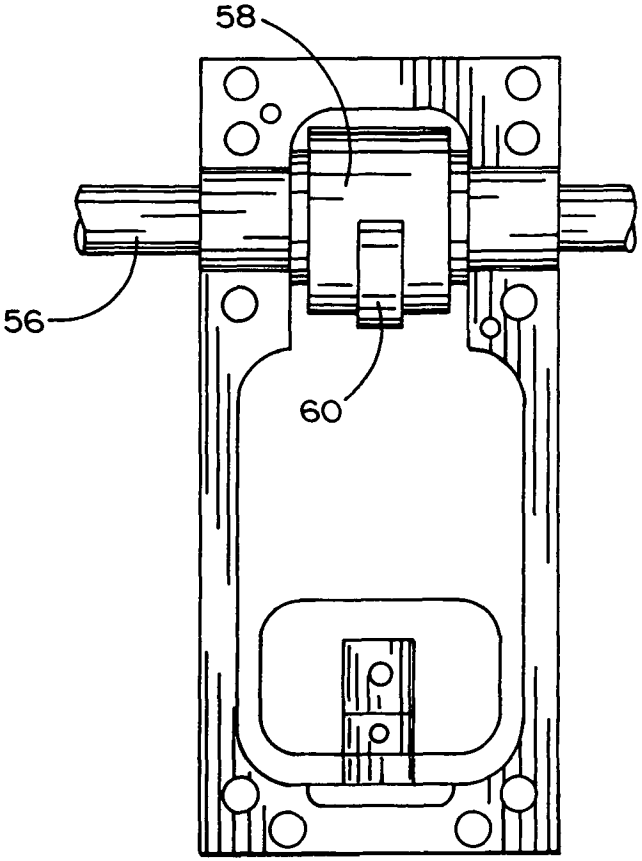
FIGS. 10 and 11 are cross-sectional and side views, respectively, of a second embodiment of the present invention.
Figure 10:
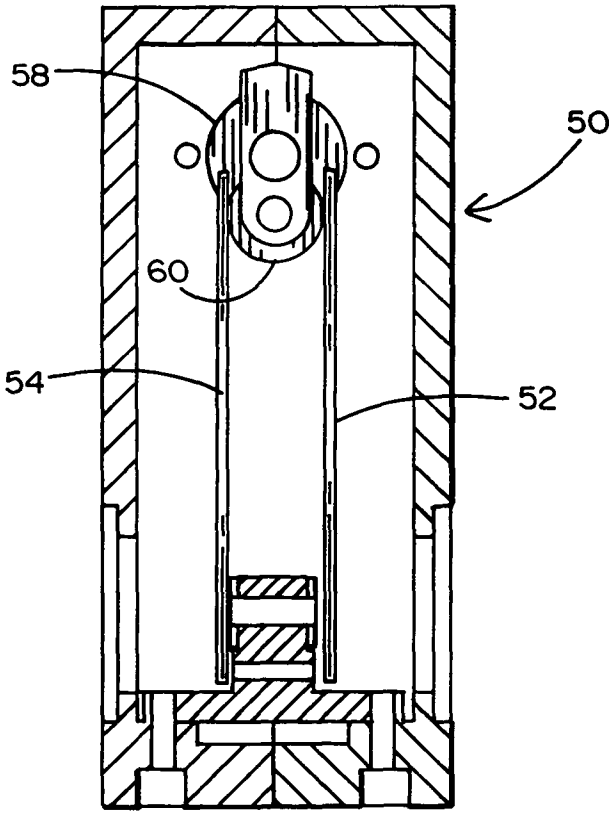
Figure 12:
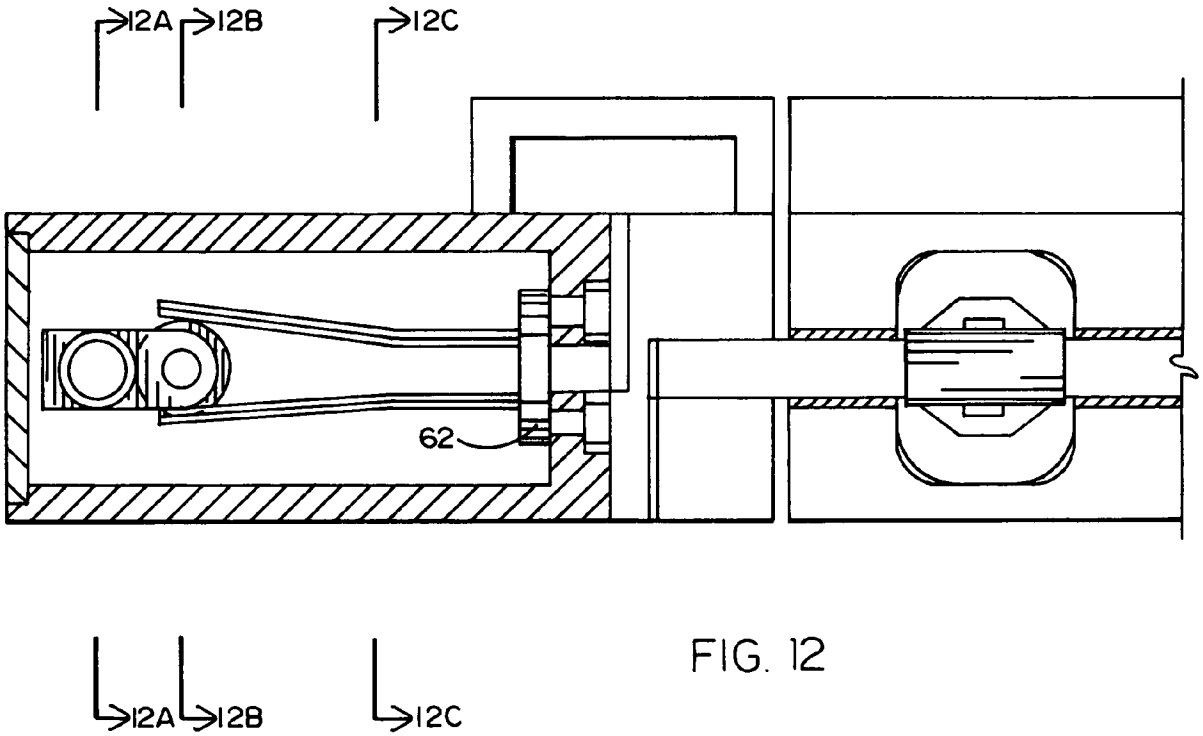
FIG. 12 is a partially cross-sectional view of a two axis assembly using the second embodiment of FIGS. 10 and 11.
Figure 12C:
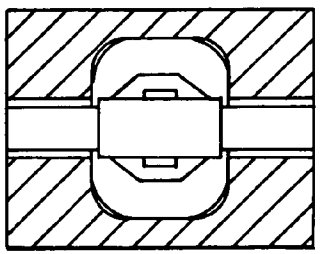
FIGS. 12A, 12B and 12C are cross-sectional views taken along lines A, B and C, respectively of FIG. 12.
Figure 12B:
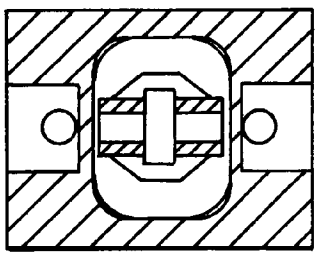
Figure 12A:
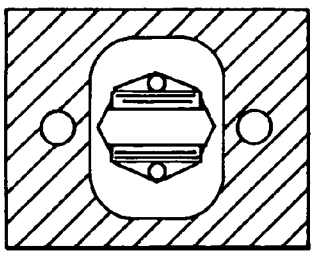
Figure 13:
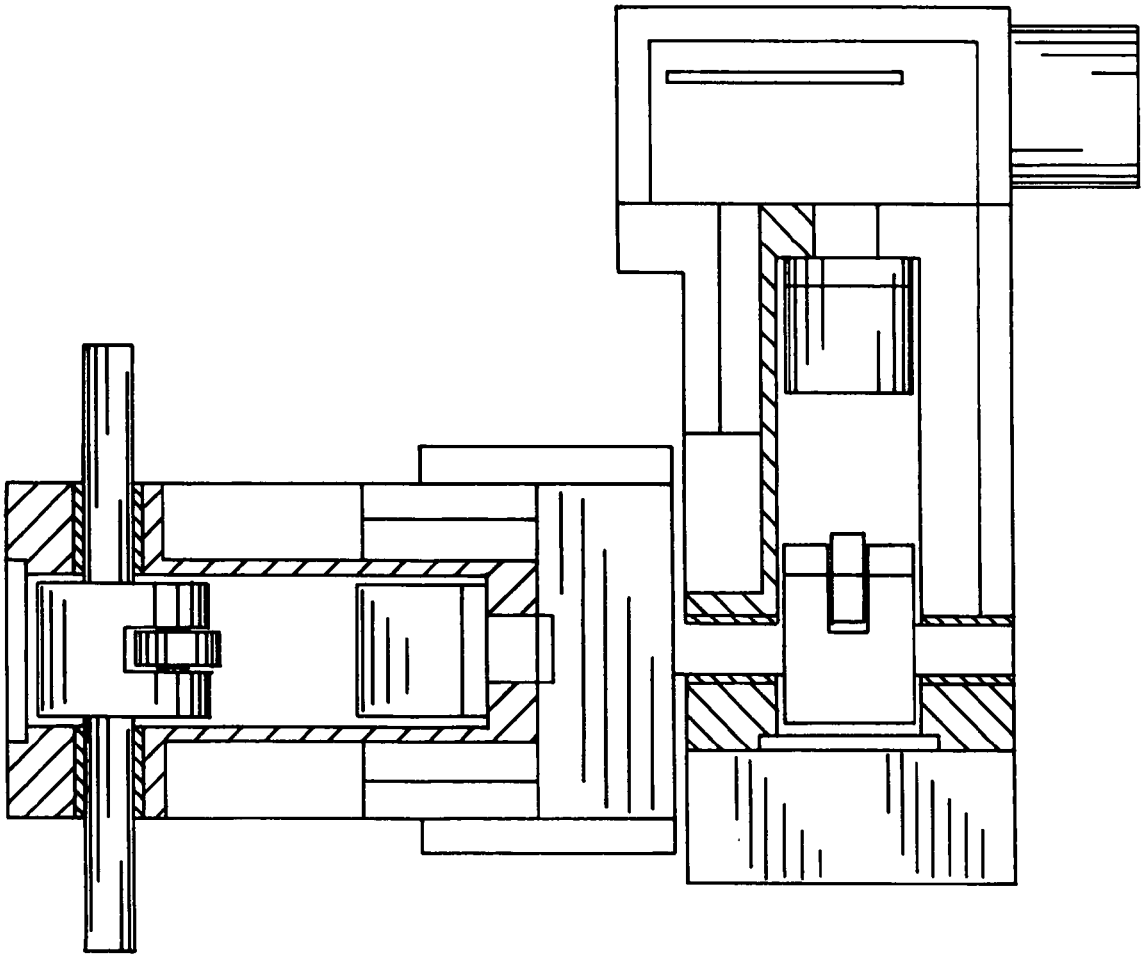
FIG. 13 is another cross-sectional view of the two axis assembly of FIG. 12.
Figure 14:
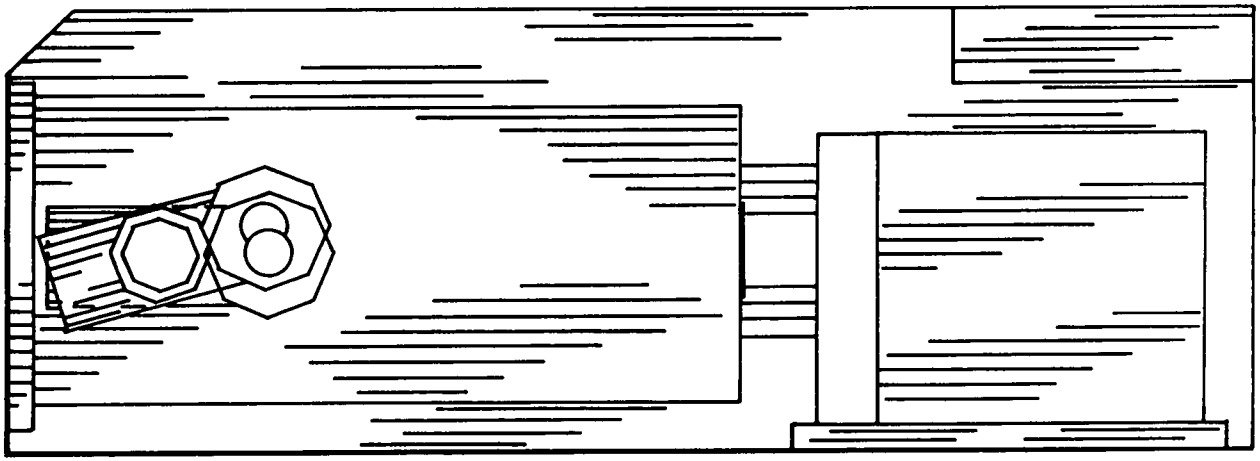
FIG. 14 is an exterior view of the assembly of FIG. 13.

A corresponding schematic diagram is shown in FIG. 9. The eight strain gauges are identified as SG-1, SG-2, SG-3, SG-4, SG-5, SG-6, SG-7 and SG-8. Terminals X1 and X2 provide X-bridge output signals and terminals Y1 and Y2 provide Y-bridge output signals. The signals will depend on the imbalances created in the strain gauge resistances based upon relative tension and compression of the stain gauges due to the magnitude and direction of a force applied to post 12. These X and Y terminals and a supply voltage and an electrical ground are connected by wires 22 to a signal conditioning circuit (not shown) on a printed circuit board (not shown) mounted in chamber 28 formed within housing 18. A suitable signal conditioning circuit is well known in the strain gauge bridge art and need not be described herein.

Strain gauges SG-1 to SG-8 are preferably formed from a deposited and fired material or glued on convention strain gauges, a material that is well known in the strain gauge art. In a typical application, the output of the full bridge circuits of FIG. 9 provide a resolution which is a variable force in each of the X and Y directions depending mechanical design of the sensing element.

The joystick controller of the present invention may also be provided as a pair of one dimension post/spring assemblies as shown in FIGS. 10-14. Each such controller 50 comprises parallel leaf springs 52, 54. At one end of the leaf springs 52, 54 there is mounted a rotatable shaft (post) 56 having a large roller 58 to which an off axis cam element 60 is affixed. Rotation of the shaft or post 56 causes cam element 60 to spread the leaf springs 52, 54 apart at the shaft end thereof. The other ends of leaf springs 52, 54 are affixed to a sensor structure 62 (see FIG. 12) upon which is mounted four strain gauges forming a single axis full bridge (X or Y) of FIG. 9. As shown best in FIG. 13, two such single axis assemblies may be joined to form a dual axis configuration, thereby providing the same capability as the joystick of FIGS. 4-7, but in two separate bridges.

Having thus disclosed preferred embodiments, it will now be apparent that the joystick described herein have substantial advantages of simplicity, reliability, durability and low cost. Moreover, it will now be perceived that various modifications may be made to the disclosed embodiment without deviating from the inventive features hereof. Accordingly, the scope of the invention shall be limited only by the appended claims and their equivalents:

We claim:

1. A joystick controller comprising:

a pair of parallel, spaced apart leaf springs joined at one common end thereof to a sensor structure having a plurality of strain gauges forming an electrical bridge;

a shaft affixed to a roller positioned between said leaf springs at an end opposite said sensor structure; said roller having a cam element for applying a separating force to said leaf springs for producing a signal in said electrical bridge which signal is generally proportional to said separating force.

2. A joystick controller having at least two single axis control devices, each control device comprising:

a pair of parallel, spaced apart leaf springs joined at one common end thereof to a sensor structure having a plurality of strain gauges forming an electrical bridge;

a shaft affixed to a roller positioned between said leaf springs at an end opposite said sensor structure; said roller having a cam element for applying a separating force to said leaf springs for producing a signal in said electrical bridge which signal is generally proportional to said separating force.

* * * * *